US008610415B2

(12) United States Patent
Maher et al.

(10) Patent No.: US 8,610,415 B2
(45) Date of Patent: Dec. 17, 2013

(54) LAMBDA CORRECTION FOR CURRENT FOLDBACK

(75) Inventors: Gregory A. Maher, Cape Elizabeth, ME (US); Hrvoje Jasa, Scarborough, ME (US)

(73) Assignee: Fairchild Semiconductor Corporation, San Jose, CA (US)

( * ) Notice: Subject to any disclaimer, the term of this patent is extended or adjusted under 35 U.S.C. 154(b) by 457 days.

(21) Appl. No.: 13/042,078

(22) Filed: Mar. 7, 2011

(65) Prior Publication Data

US 2012/0229109 A1 Sep. 13, 2012

(51) Int. Cl.
*G05F 1/569* (2006.01)
*G05F 1/575* (2006.01)

(52) U.S. Cl.
USPC ..... 323/274; 323/277; 323/280

(58) Field of Classification Search
USPC ..... 323/273–277, 279, 280
See application file for complete search history.

(56) References Cited

U.S. PATENT DOCUMENTS

| | | | | |
|---|---|---|---|---|
| 6,300,749 | B1 * | 10/2001 | Castelli et al. | 323/273 |
| 6,700,361 | B2 * | 3/2004 | Gregorius | 323/282 |
| 2008/0265852 | A1 * | 10/2008 | Imura | 323/277 |
| 2008/0278127 | A1 * | 11/2008 | Nagata | 323/276 |
| 2009/0128106 | A1 * | 5/2009 | Takahashi et al. | 323/277 |
| 2012/0187930 | A1 * | 7/2012 | Williams et al. | 323/273 |

* cited by examiner

*Primary Examiner* — Adolf Berhane
*Assistant Examiner* — Fred E Finch, III
(74) *Attorney, Agent, or Firm* — Schwegman Lundberg Wossner P.A.

(57) ABSTRACT

Method and apparatus to provide lambda correction of a current foldback circuit using a regulator including a current foldback circuit are disclosed herein.

16 Claims, 2 Drawing Sheets

LAMBDA CORRECTION FOR CURRENT FOLDBACK

BACKGROUND

Power transfer devices often include circuits designed to reduce harmful power transfer during an unexpected transfer condition, such as a short circuit condition. Harmful transfer conditions can include transferring extreme voltages, transferring extreme current or transferring unexpected combinations of current and voltage.

OVERVIEW

In certain examples, an apparatus can include a charge device, a first amplifier, and a current sense circuit. The current sense circuit can include a feedback transistor, a sense transistor, a feedback resistor, a second amplifier, and a transconductance amplifier. The charge device can include a charge transistor, and can be configured to couple an input supply node to an output supply node, wherein a resistance of the charge device can be responsive to control information received at a control node of the charge switch. The first amplifier can be configured to compare feedback information to a current limit threshold and to modulate the control information received at the control node of the charge device using the comparison. The current sense circuit can be configured to provide the feedback information. The sense transistor of the current sense circuit can be configured to be coupled the input supply node with a first terminal of the feedback transistor, the sense transistor having a control node coupled to the control node of the charge switch. The feedback resistor of the current sense circuit can be coupled between a reference potential and a second terminal of the feedback transistor. The feedback resistor can be configured to provide load current information of the output supply node. The feedback information provided by the current sense circuit can include the load current information.

The second amplifier can be configured to compare a voltage of the output supply node to a sensed voltage at an output node of the sense transistor, and to modulate a control node of the feedback transistor using the comparison. The transconductance amplifier can be configured to compare the voltage of the output supply node to a foldback reference voltage and to use the comparison to provide foldback information. The foldback information can be configured to increase the resistance of the charge device when the voltage of the output supply node falls below the foldback reference voltage. The feedback information provided by the current sense circuit can include the foldback information.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
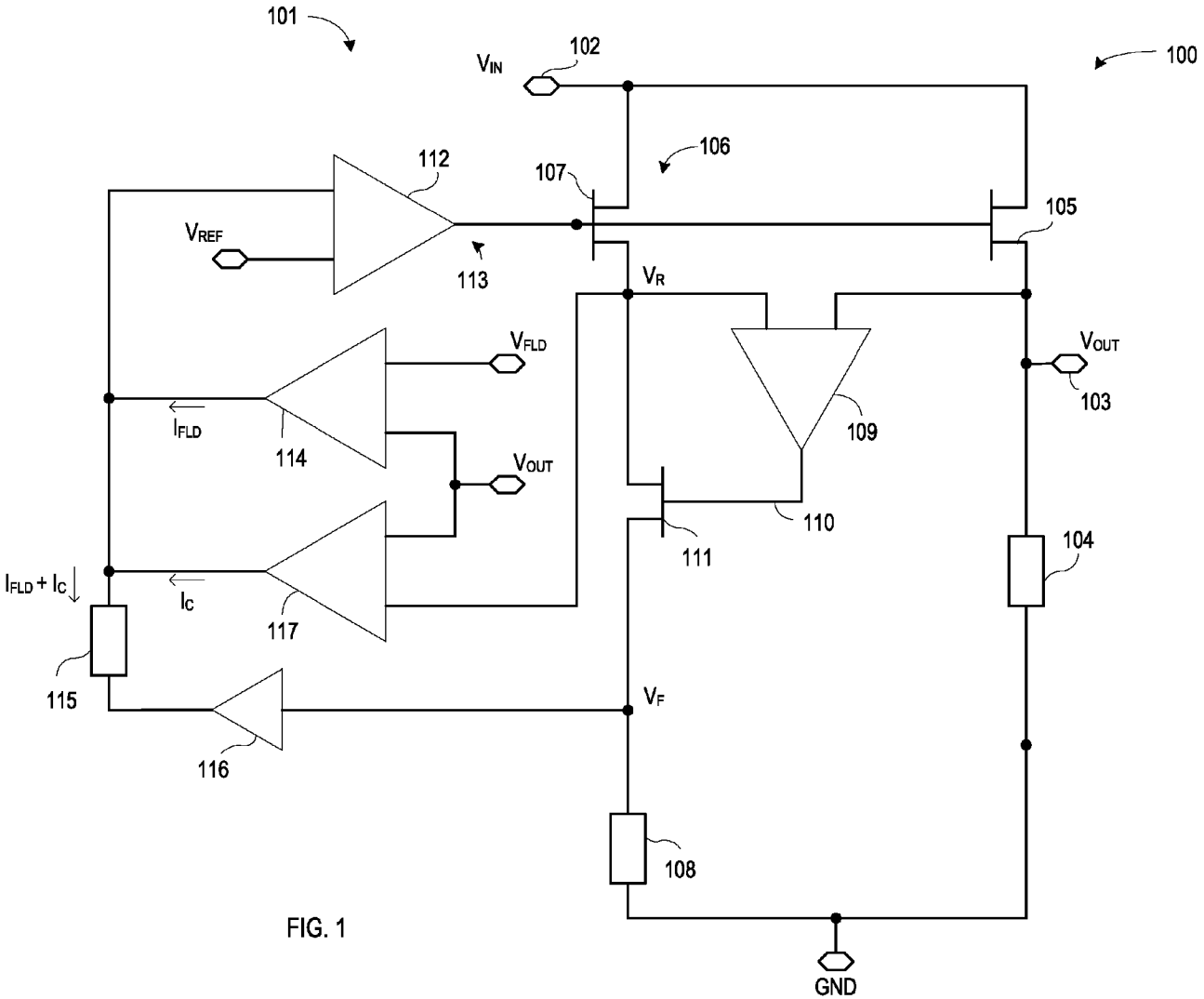
FIG. 1 illustrates generally a voltage regulator including a current foldback circuit having lambda correction.

Power transfer devices, such as chargers to recharge energy storage components of electronic devices, can often include circuitry to protect the power transfer electronics and connected devices when an unexpected power transfer condition arises. A short current condition is an example of an unexpected power transfer condition that, if not considered in the design of a power transfer device, can cause irreparable harm to both the power transfer device and the device being charged. During a power transfer event, such as when charging or powering one device from another, a nominal voltage and current flow is typically maintained between the devices. In some situations, such as a charging situation, current flow can be greater when the power transfer first starts and then can lessen as the charging nears completion. During an unexpected short circuit event, the load resistance of the charger device can become very low and the demand for current can be very high. The charger typically tries to maintain a nominal voltage and in an effort to do so can increase the amount of current supplied to the load. Increasing current to maintain or to increase voltage increases the power delivered by the charger. With no protection, the charger can exceed the power transfer capacity of the charger electronics, thus, thermally overloading the electronics in a short amount of time.

As electronic devices have become smaller, more powerful in terms of computing power, or more portable because of both reduced size and energy storage capacity, accessory devices, such as Universal Serial Bus (USB) accessories, have been developed that enhance and take advantage of the size, computing power, and energy storage of the electronic devices. Energy transfer can take place when one or more accessories are plugged into a device or enabled by the device. Electronic components of devices, especially small portable electronic devices, can have thermal limits that when exceeded can cause irreparable harm. Current foldback circuits can be used to control power transfer in situations where an unexpected short circuit has occurred. Current foldback techniques can monitor and reduce a supplied voltage, for example, using an increased output resistance, when the voltage is pulled below a threshold, such as a foldback threshold. The foldback circuit can control the supplied current, as the voltage is pulled lower and lower by a low resistance load, such as a short circuit load, to prevent thermally overloading electronics, such as the device electronics. As the voltage approaches a reference voltage of the current foldback circuit, the supplied current can begin to climb. The current increase can be due to a threshold voltage effect, or lambda effect, that becomes prominent as the supply voltage approaches the reference voltage.

The present inventors have recognized that the rise in current from the lambda effect can cause thermal strain that can impair or disable operation of one or more electronic components of a device. This description provides apparatus and methods to compensate for the lambda effect.

FIG. 1 illustrates generally a regulator 100 including a current foldback circuit 101 having lambda correction. The regulator 100 includes an input supply node 102 configured to receive an input voltage $V_{IN}$, such as from a power supply, and an output supply node 103 to supply an output voltage $V_{OUT}$, for example, to a load 104. The regulator 100 can include a charge device 105, such as, but not limited to, a switch, a transistor, such as a field effect transistor, or other active device. The charge device 105 can be configured to couple the input supply node 102 to the output supply node 103. The regulator 100 can include a ratio branch 106 configured to provide a sample voltage, $V_R$, which is a representation of the output voltage $V_{OUT}$ supplied to the load 104. The ratio branch 106 can include a sample device, such as a switch or a sense transistor 107, configured to couple the input supply node 102 to a first feedback resistor 108. The regulator 100 can include an amplifier 109 to compare the output voltage $V_{OUT}$ at the output supply node 103 and the sample voltage $V_R$ at the sense transistor 107. The amplifier 109 can provide feedback command information 110 indicative of the difference between the sample voltage $V_R$ and output voltage $V_{OUT}$. The feedback command information 110 can include information about current supplied to the load 104, or output current information. The feedback command information 110, including the output current information, can be converted to a feedback voltage $V_F$ using a feedback transistor 111 coupled in series between the sense transistor 107 and the first feedback resistor 108. In an example, a first terminal of the feedback transistor 111 can be coupled to the sense transistor 107, a second terminal of the feedback transistor can be coupled to the first feedback resistor 108, and a control node of the feedback transistor can be coupled to the amplifier 109 and configured to respond to the feedback command information 110. A second amplifier 112 can compare the feedback voltage $V_F$ to a predetermined reference voltage $V_{REF}$ to regulate current supplied to the load 104. In an example, the current supplied to the load can be regulated by adjusting, or modulating, a resistance of the charge device 105. In an example, an output 113 of the second amplifier can be coupled to a control node of the sense transistor 107 and the charge device 105.

In an example, the current foldback circuit 101 can include a first transconductance amplifier 114. The first transconductance amplifier 114 can be configured to receive the output voltage $V_{OUT}$ and a foldback reference voltage $V_{FLD}$, and can be configured to provide a current indicative of the difference between the output voltage $V_{OUT}$ and the foldback reference voltage $V_{FLD}$. In an example, the first transconductance amplifier 114 can provide a current indicative of the difference between the output voltage $V_{OUT}$ and the foldback reference voltage $V_{FLD}$ when the output voltage $V_{OUT}$ is less than the foldback reference voltage $V_{FLD}$. The current $I_{FLD}$ can generate a voltage across a second feedback resistor 115. In an example, a buffer 116 can isolate the second feedback resistor 115 from the first feedback resistor 108. The voltage generated by the current $I_{FLD}$ from the first transconductance amplifier 114 can be added to the voltage generated across the first feedback resistor 108 to provide feedback information to the second amplifier 112 to further adjust the resistance of the charge device 105. In an example, as output voltage $V_{OUT}$ falls and load current rises, due to, for example, a short across the load 104, the first transconductance amplifier 114 can provide a current $I_{FLD}$ indicative of the output voltage $V_{OUT}$ below the foldback reference voltage $V_{FLD}$. The current $I_{FLD}$ can generate feedback voltage across the second resistor 115. The feedback voltage can appear to the second amplifier 112 to indicate that the output voltage $V_{OUT}$ is too high. In response to the comparison, the second amplifier 112 can bias the control node of the charge device 105 such that the resistance across the charge device increases, thus reducing, or folding back, the current to the load 104.

In an example, the foldback circuit 101 can include a second transconductance amplifier 117. The second transconductance amplifier 117 can provide a lambda correction to maintain control of the foldback current as the output voltage $V_{OUT}$ approaches a reference potential, such as ground GND. The second transconductance amplifier 117 can receive the output voltage $V_{OUT}$ and a sample voltage $V_R$ provided using the ratio branch 106. In general, the output voltage $V_{OUT}$ and sample voltage $V_R$ mirror each other, with some regulation deviation, even as the output voltage $V_{OUT}$ falls due to a short across the load 104, for example. However, as the output voltage $V_{OUT}$ nears the reference voltage, the physical differences between the charge device 105 and the sense transistor 107 can begin to cause significant deviation between the output voltage $V_{OUT}$ and the sample voltage $V_R$. Such deviation can result in a rise in short circuit, foldback current. A rise in short circuit, foldback current can precipitate violation of thermal design constraints. Continued and persistent violation of the thermal constraints due to short circuit current can shorten the operational life of the regulator 100, other components within the device using the regulator 100, or the device itself. The second transconductance amplifier 117 can respond to deviations between the output voltage $V_{OUT}$ and the sample voltage $V_R$ and maintain a desired foldback current profile that is within the thermal constraints of the regulator 100 or the device. In an example, the second transconductance amplifier 117 can respond to relatively large deviations between the output voltage $V_{OUT}$ and the sample voltage $V_R$ that can occur as the output voltage $V_{OUT}$ approaches a reference potential due to a short across the load 104. The second transconductance amplifier 117 can provide a current $I_C$ indicative of the difference between the output voltage $V_{OUT}$ and the sample voltage $V_R$. The current $I_C$ can be summed with the current $I_{FLD}$ of the first transconductance amplifier 114 and provide at least a portion of the feedback information received by the second amplifier 112. In an example, the second transconductance amplifier 117 can provide an output current $I_C$ to maintain or limit a foldback current level as the output voltage $V_{OUT}$ approaches a reference potential. In an example, the second transconductance amplifier 117 can provide the output current $I_C$ to reduce foldback current as the output voltage $V_{OUT}$ approaches a reference voltage. In certain examples, the second transconductance amplifier 117 can provide lamda correction to compensate for the threshold voltage differences that can exist between the ratio branch 106 of the regulator 100 and the branch of the regulator 100 that includes the load 104. In an example, the threshold voltage can be associated with the feedback transistor 111. The differences in the branches can become significant when the output voltage $V_{OUT}$ approaches the reference potential under current foldback conditions.

Figure 2A:
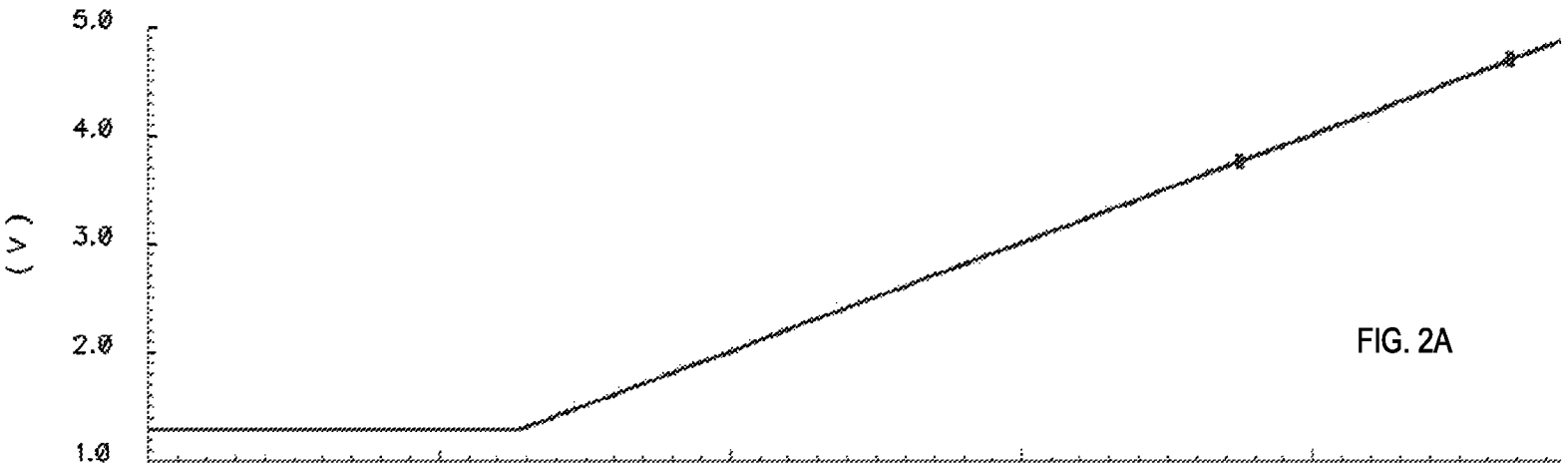
FIGS. 2A and 2B illustrate generally sample voltage, and current foldback curves as a function of output voltage with and without lambda correction.
Figure 2B:
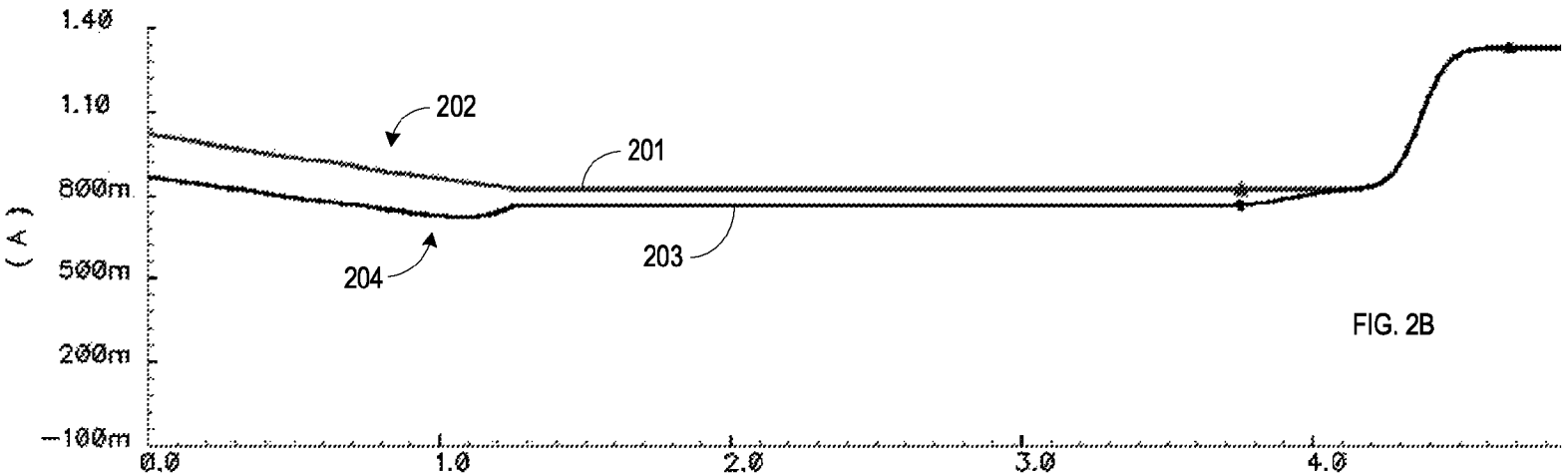

FIGS. 2A and 2B illustrate generally sample voltage and current foldback curves as a function of an output voltage $V_{OUT}$ with and without lambda correction. FIG. 2A illustrates generally sampled voltage, such as $V_R$, as function of output voltage $V_{OUT}$, for example. The plot of FIG. 2A provides a reference for the current foldback curves of FIG. 2B. In FIG. 2B, a first foldback curve 201 illustrates, at 202, that load current can climb as the short circuit output voltage $V_{OUT}$ approaches a reference potential when using a regulator without lambda correction. Such a climb, at 202, in the short circuit current can cause thermal stress beyond the capacity of the regulator or components coupled to the regulator. In contrast, a regulator with lambda correction, as shown in a second foldback curve 203, better limits the current rise, at 204, when the output voltage $V_{OUT}$ approaches the reference potential under a short circuit condition. In the illustrated example, lambda correction reduces the short-circuit current as the output voltage $V_{OUT}$ approaches the reference voltage. Limiting the current rise can protect the regulator, and other components coupled to the regulator, from failure due to excessive current stress during a short circuit situation.

ADDITIONAL NOTES

Example 1 includes an apparatus including a charge device configured to couple an input supply node to an output supply node, wherein a resistance of the charge device is responsive to control information received at a control node of the charge switch, a first amplifier configured to compare feedback information to a current limit threshold and to modulate the control information received at the control node of the charge device using the comparison, and a current sense circuit configured to provide the feedback information. The current sense circuit can include a feedback transistor, a sense transistor configured to coupled the input supply node with a first terminal of the feedback transistor, the sense transistor having a control node coupled to the control node of the charge switch, a first feedback resistor coupled between a reference potential and a second terminal of the feedback transistor, the feedback resistor configured to provide load current information of the output supply node, wherein the feedback information includes the load current information, a second amplifier configured to compare a voltage of the output supply node to a sensed voltage at an output node of the sense transistor, the second amplifier further configured to modulate a control node of the feedback transistor using output information of the second amplifier, and a first transconductance amplifier configured to compare the voltage of the output supply node to a foldback reference voltage and to use the comparison to provide foldback information as part of the feedback information, wherein the foldback information is configured to increase the resistance of the charge device when the voltage of the output supply node falls below the foldback reference voltage.

In Example 2, the charge device of Example 1 optionally includes a transistor.

In Example 3, the current sense circuit of any one or more of Examples 1 and 2 optionally includes a second feedback resistor configured to generate the foldback information using a current output of the first transconductance amplifier.

In Example 4, the current sense circuit of any one or more of Examples 1-3 optionally includes a buffer configured to buffer the first feedback resistor from the second feedback transistor.

In Example 5, the current sense circuit of any one or more of Examples 1-4 optionally includes a second transconductance amplifier configured to compare the voltage of the output supply node to the sensed voltage and to use the comparison to provide compensation information as part of the feedback information, the compensation information configured to increase the resistance of the charge device when the voltage at the output supply node approaches the reference potential, and to compensate for at least one threshold voltage difference between the sensed voltage and the voltage at the output supply node.

In Example 6, the at least one threshold voltage difference of any one or more of Examples 1-5 is optionally associated with the feedback transistor.

In Example 7, the current sense circuit of any one or more of Examples 1-6 optionally includes a second feedback resistor configured to sum load current information with the foldback and the compensation information using current outputs of the first and second transconductance amplifiers.

In Example 8, the current sense circuit of any one or more of Examples 1-7 optionally includes a buffer configured to buffer the second feedback resistor from the first amplifier.

In Example 9, a method can include comparing feedback information to a current limit threshold using a first amplifier, generating and modulating control information at the output of the first amplifier, receiving the control information at a control node of a charge switch, adjusting a resistance of the charge device using the control information, the resistance of the charge device coupled between an input supply node and an output supply node, and monitoring a current at the output supply node to produce output current information, the feedback information including the output current information. The monitoring can include receiving the control information at a control node of a sense transistor, comparing a sensed voltage at an output node of the sense transistor to a voltage at the output supply node using a second amplifier, generating feedback command information at an output of the second amplifier, and receiving the feedback command information at a control node of a feedback transistor. The method can further include generating the output current information using a switch node of the feedback transistor and a first feedback resistor, the first feedback resistor coupled between the feedback transistor and a reference potential, comparing the voltage at the output node of the charge device to a foldback reference voltage using a first transconductance amplifier, and generating current foldback information at a summing node coupled to an output of the first transconductance amplifier, wherein the feedback information includes the current foldback information. The adjusting the resistance can include increasing the resistance of the charge device in response to the current foldback information when the voltage at the output node of the charge device falls below the foldback reference voltage.

In Example 10, the method of any one or more of Examples 1-9 can optionally include buffering the first feedback resistor from the first amplifier.

In Example 11, the generating current foldback information of any one or more of Examples 1-10 optionally includes generating a current foldback information voltage using a second feedback resistor and a current output of the first transconductance amplifier.

In Example 12, the method of any one or more of Examples 1-11 optionally includes buffering the first feedback resistor from the second feedback resistor.

In Example 13, the method of any one or more of Examples 1-12 optionally includes comparing a sensed voltage at the output node of the sense transistor to the voltage at the output supply node using a second transconductance amplifier, and generating compensation information at the output of the second transconductance amplifier, wherein the feedback information includes the compensation information. The adjusting the resistance can include compensating for at least one threshold voltage difference between the sensed voltage and the voltage at the output supply node as the output supply node approaches the reference potential, and the compensating can include increasing the resistance of the charge device in response to the compensation information when the voltage at the output supply node approaches the reference potential.

In Example 14 the compensating for at least one threshold voltage difference of any one or more of Examples 1-13 optionally includes compensating for the threshold voltage associated with the feedback transistor.

In Example 15, the generating compensation information of any one or more of Examples 1-14 optionally includes generating a compensation information voltage using a second feedback resistor coupled to the summing node and a current output of the second transconductance amplifier.

In Example 16, the method of any one or more of Examples 1-15 optionally includes buffering the first feedback resistor from the second feedback resistor.

Example 17 can include, or can optionally be combined with any portion or combination of any portions of any one or more of Examples 1-16 to include, subject matter that can include means for performing any one or more of the functions of Examples 1-16, or a machine-readable medium including instructions that, when performed by a machine, cause the machine to perform any one or more of the functions of Examples 1-16.

These non-limiting examples can be combined in any permutation or combination.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An apparatus comprising:

a charge device configured to couple an input supply node to an output supply node, wherein a resistance of the charge device is responsive to control information received at a control node of the charge switch;

a first amplifier configured to compare feedback information to a current limit threshold and to modulate the control information received at the control node of the charge device using the comparison; and a current sense circuit configured to provide the feedback information, the current sense circuit including:

a feedback transistor;

a sense transistor configured to coupled the input supply node with a first terminal of the feedback transistor, the sense transistor having a control node coupled to the control node of the charge switch;

a first feedback resistor coupled between a reference potential and a second terminal of the feedback transistor, the feedback resistor configured to provide load current information of the output supply node, wherein the feedback information includes the load current information;

a second amplifier configured to compare a voltage of the output supply node to a sensed voltage at an output node of the sense transistor, the second amplifier further configured to modulate a control node of the feedback transistor using output information of the second amplifier; and a first transconductance amplifier configured to compare the voltage of the output supply node to a foldback reference voltage and to use the comparison to provide foldback information as part of the feedback information, wherein the foldback information is configured to increase the resistance of the charge device when the voltage of the output supply node falls below the foldback reference voltage.

2. The apparatus of claim 1, wherein the charge device includes a transistor.

3. The apparatus of claim 1, wherein the current sense circuit includes a second feedback resistor configured to generate the foldback information using a current output of the first transconductance amplifier.

4. The apparatus of claim 3, wherein the current sense circuit includes a buffer configured to buffer the first feedback resistor from the second feedback transistor.

5. The apparatus of claim 1, wherein the current sense circuit includes a second transconductance amplifier configured to compare the voltage of the output supply node to the sensed voltage and to use the comparison to provide compensation information as part of the feedback information, the compensation information configured to increase the resistance of the charge device when the voltage at the output supply node approaches the reference potential, and to compensate for at least one threshold voltage difference between the sensed voltage and the voltage at the output supply node.

6. The apparatus of claim 5, wherein the at least one threshold voltage difference is associated with the feedback transistor.

7. The apparatus of claim 5, wherein the current sense circuit includes a second feedback resistor configured to sum load current information with the foldback and the compensation information using current outputs of the first and second transconductance amplifiers.

8. The apparatus of claim 7, wherein the current sense circuit includes a buffer configured to buffer the second feedback resistor from the first amplifier.

9. A method comprising:

comparing feedback information to a current limit threshold using a first amplifier;

generating and modulating control information at the output of the first amplifier;

receiving the control information at a control node of a charge switch;

adjusting a resistance of the charge device using the control information, the resistance of the charge device coupled between an input supply node and an output supply node;

monitoring a current at the output supply node to produce output current information, the feedback information including the output current information, wherein the monitoring includes:

receiving the control information at a control node of a sense transistor;

comparing a sensed voltage at an output node of the sense transistor to a voltage at the output supply node using a second amplifier;

generating feedback command information at an output of the second amplifier;

receiving the feedback command information at a control node of a feedback transistor;

generating the output current information using a switch node of the feedback transistor and a first feedback resistor, the first feedback resistor coupled between the feedback transistor and a reference potential;

comparing the voltage at the output node of the charge device to a foldback reference voltage using a first transconductance amplifier;

generating current foldback information at a summing node coupled to an output of the first transconductance amplifier, wherein the feedback information includes the current foldback information; and wherein adjusting the resistance includes increasing the resistance of the charge device in response to the current foldback information when the voltage at the output node of the charge device falls below the foldback reference voltage.

10. The method of claim 9, including buffering the first feedback resistor from the first amplifier.

11. The method of claim 9, wherein the generating current foldback information includes generating a current foldback information voltage using a second feedback resistor and a current output of the first transconductance amplifier.

12. The method of claim 11, including buffering the first feedback resistor from the second feedback resistor.

13. The method of claim 9, including:

comparing a sensed voltage at the output node of the sense transistor to the voltage at the output supply node using a second transconductance amplifier;

generating compensation information at the output of the second transconductance amplifier, wherein the feedback information includes the compensation information;

wherein adjusting the resistance includes compensating for at least one threshold voltage difference between the sensed voltage and the voltage at the output supply node as the output supply node approaches the reference potential; and wherein the compensating includes increasing the resistance of the charge device in response to the compensation information when the voltage at the output supply node approaches the reference potential.

14. The method of claim 13, wherein the compensating for at least one threshold voltage difference includes compensating for the threshold voltage associated with the feedback transistor.

15. The method of claim 14, wherein the generating compensation information includes generating a compensation information voltage using a second feedback resistor coupled to the summing node and a current output of the second transconductance amplifier.

16. The method of claim 15, including buffering the first feedback resistor from the second feedback resistor.

* * * * *